US007009102B2

(12) United States Patent
Milner

(10) Patent No.: US 7,009,102 B2
(45) Date of Patent: Mar. 7, 2006

(54) WILDLIFE GUARD FOR ARRESTER BRACKETS

(75) Inventor: Bobby A. Milner, Pine Bluff, AR (US)

(73) Assignee: Central Moloney, Inc., Pine Bluff, AR (US)

( * ) Notice: Subject to any disclaimer, the term of this patent is extended or adjusted under 35 U.S.C. 154(b) by 31 days.

(21) Appl. No.: 10/891,425

(22) Filed: Jul. 14, 2004

(65) Prior Publication Data

US 2005/0073779 A1 Apr. 7, 2005

Related U.S. Application Data

(60) Provisional application No. 60/487,557, filed on Jul. 15, 2003.

(51) Int. Cl.
*H01B 17/00* (2006.01)

(52) U.S. Cl. ..... 174/5 R; 174/138 F; 174/139

(58) Field of Classification Search ..... 174/5 R, 174/138 F, 139; 29/235; D13/118, 129
See application file for complete search history.

(56) References Cited

U.S. PATENT DOCUMENTS 983,039 A 1/1911 Field
1,177,867 A 4/1916 Johnson
1,598,155 A 8/1926 Salisbury
1,988,435 A 1/1935 Beebe
2,065,315 A 12/1936 Keath
2,682,591 A 6/1954 Killian
2,834,829 A 5/1958 Broverman
2,875,267 A 2/1959 Sutton, Jr.
3,042,736 A 7/1962 Salisbury
3,079,457 A 2/1963 Newcomb, Jr.
3,133,984 A 5/1964 Farough et al.
3,238,291 A 3/1966 Bosch et al.
3,270,120 A 8/1966 Van Name et al.
3,328,511 A 6/1967 Cagle et al.
3,510,568 A 5/1970 Cochrane
3,639,678 A * 2/1972 Muschong ..... 174/5 R
3,639,681 A 2/1972 Ettlinger
3,824,676 A 7/1974 Ebert
3,922,476 A 11/1975 Clutter et al.
4,159,395 A 6/1979 Cogelia
4,255,610 A 3/1981 Textoris
4,280,013 A 7/1981 Clutter
4,433,630 A 2/1984 Laborie (Continued)

OTHER PUBLICATIONS

Product Data Sheet, Shedmount Wildlife Guards, Central Moloney, Inc., Pine Bluff, Arkansas, Aug. 20, 2003, 2 pages.

(Continued)

*Primary Examiner*—Dean A. Reichard
*Assistant Examiner*—Adolfo Nino
(74) *Attorney, Agent, or Firm*—Ray F. Cox, Jr.

(57) ABSTRACT

An insulating cap and method of using the same is disclosed. The insulating cap has one or more slots sized to accept edges of a rib of an arrester bracket so that the cap may be affixed to the rib by sliding the cap over the rib. Tabs at lower portions of the slotted side portions provide for snap fitting the cap to the rib. A cover portion of the cap extends forward from the slotted portion and is sized to at least partially cover a bolt or fastener that connects the arrester bracket to a mounting bracket that is, in turn, affixed to a transformer tank. The cover portion has curved or rounded upper surfaces to serve as a perch deterrent. The insulating cap is formed from a UV stabilized, polypropylene copolymer.

20 Claims, 2 Drawing Sheets

U.S. PATENT DOCUMENTS

| | | | | |
|---|---|---|---|---|
| 4,449,010 | A | | 5/1984 | Apperson et al. |
| 4,542,363 | A | | 9/1985 | Kato et al. |
| 4,628,145 | A | | 12/1986 | Kolcio et al. |
| 4,680,428 | A | * | 7/1987 | Wilson, Jr. ..... 174/158 F |
| 4,707,562 | A | | 11/1987 | Whited |
| 4,845,307 | A | | 7/1989 | Cumming et al. |
| 4,906,801 | A | * | 3/1990 | Beasley ..... 174/5 R |
| 5,153,383 | A | | 10/1992 | Whited et al. |
| D348,429 | S | | 7/1994 | Farmer |
| D357,458 | S | | 4/1995 | Tisbo |
| 5,648,641 | A | | 7/1997 | Guthrie |
| 5,650,594 | A | | 7/1997 | Urnovitz |
| 5,679,922 | A | | 10/1997 | Harben |
| 5,682,015 | A | * | 10/1997 | Harben ..... 174/5 R |
| 5,794,495 | A | | 8/1998 | Anderson |
| 5,864,096 | A | | 1/1999 | Williams et al. |
| 5,873,324 | A | | 2/1999 | Kaddas et al. |
| 5,994,644 | A | | 11/1999 | Rindoks et al. |
| 6,005,196 | A | | 12/1999 | Spillyards |
| 6,018,453 | A | | 1/2000 | Daharsh et al. |
| 6,248,956 | B1 | | 6/2001 | Cook et al. |
| 6,255,597 | B1 | | 7/2001 | Bowling et al. |
| 6,291,774 | B1 | | 9/2001 | Williams |
| 6,486,785 | B1 | | 11/2002 | Hoth |
| 6,683,249 | B1 | * | 1/2004 | Leppin ..... 174/5 R |
| 6,730,852 | B1 | * | 5/2004 | Puigcerver et al. ..... 174/138 F |
| 6,770,809 | B1 | * | 8/2004 | De France ..... 174/5 R |
| 6,878,883 | B1 | | 4/2005 | Rauckman |
| 2002/0117313 | A1 | | 8/2002 | Spencer |
| 2003/0015330 | A1 | | 1/2003 | Wood et al. |
| 2003/0140735 | A1 | | 7/2003 | Weaver et al. |

OTHER PUBLICATIONS

Catalog, One Piece Wildlife Protector, Cat. No. GS-560, Fargo Mfg. Company, Inc., Poughkeepsie NY, Sep. 1988, 1 page.

Catalog, One Piece Wildlife Protector, Cat. No. GS-565, Fargo Mfg. Company, Inc., Poughkeepsie NY, at least as early as Jul. 4, 1989 (date of issuance of U.S. Pat. No. 4,845,307), 1 page.

New Product Bulletin, Fargo GS-500 Series Wildlife Protectors for Equipment Bushings, Fargo Mfg. Company, Inc., Poughkeepsie NY, Jul. 1990, 2 pages.

Catalog, One Piece Wildlife Protector, Fargo Mfg. Company, Inc., Poughkeepsie NY, Oct. 1990, 1 page.

Production Drawing, Shed Mount Wildlife Guard, Central Moloney, Inc., Pine Bluff AR, Dec. 1, 1998, offer for sale at least as early as Sep. 1998, 1 page.

Product Data Shee, "Shedmount" Wildlife Guard, File No. PDS1033, Central Moloney, Inc., Pine Bluff AR, Nov. 15, 1998, offer for sale at least as early as Sep. 1998, 2 pages.

Website, www.hendrix-wc.com, BG-9 Wildlife Guard, Hendrix Wire & Cable, Inc., Milford NH, at least as early as Feb. 8, 2004, 1 page.

* cited by examiner

WILDLIFE GUARD FOR ARRESTER BRACKETS

This application claims priority from U.S. Provisional Patent Application Ser. No. 60/487,557, filed on Jul. 15, 2003.

BACKGROUND OF THE INVENTION

This invention relates to insulating covers for electrical equipment and, more particularly, to insulating covers to prevent or reduce power interruptions on distribution utility lines caused when wildlife bridge high voltage circuits.

Power quality has become an important issue with utility companies as customers increasingly demand uninterrupted power feeding their establishments. Increased use of computers and digital equipment has significantly increased expectations for continuous power, free of momentary interruptions. The leading cause of power interruptions on distribution utility lines is bridging of high voltage circuits by wildlife. Birds and squirrels are the most frequent offenders. To reduce the outages associated with wildlife perching or sitting on distribution transformers, molded covers of various styles, made of insulating materials, are being utilized on the high voltage connections to prevent the animals from making contact with these connections.

Many transformers have lightning arresters mounted to the side of the transformer tanks. These arresters typically mount to a metal bracket that is bolted to the transformer tank. Although these arresters typically employ a small wildlife cover, it is generally not effective in preventing wildlife from making contact with the energized parts. A common cause of outages is wildlife perching near the arrester bracket and mounting bracket at ground potential and making contact with the high voltage connection on the arrester. The animal, being electrically conductive, initiates a high current electrical arc to the arrester bracket. This typically results in operation of high current protective devices, such as fuses, which disconnect the transformer from the circuit, thereby interrupting power to the customers being fed from this transformer. Often the heat of the electrical arc damages the transformer and or the arrester. The power to the customer is not restored until a service lineman becomes available to replace the damaged equipment.

To prevent these types of outages, utilities have attempted to insulate the mounting point of these arresters so that animals perching in this area are effectively insulated from ground potential to prevent current flow when they make contact with the high voltage connection on the arrester. Utilities have tried using things such as tape, insulating putty, and molded bolt caps in an attempt to insulate this perching point. None have proven truly effective over the long term.

SUMMARY OF THE INVENTION

It is therefore an object of the present invention to provide a device and method of using the same that provides for improved protection against power outages caused by wildlife.

It is a further object of the present invention to provide a durable and inexpensive insulating cap that is easily installed and removed and that provides for improved protection against power outages caused by wildlife.

It is a further object of the present invention to provide an insulating cap that may be easily installed and removed without the use of cumbersome latches, tie straps, tape, or tools.

It is a further object of the present invention to provide an insulating cap that deters wildlife from perching in areas near an energized conductor.

It is a still further object of the present invention to provide an insulating cap that may be easily snap fitted over an insulating rib of an arrester bracket.

It is a still further object of the present invention to provide an insulating cap that provides for improved protection of an area surrounding a mounting bolt that affixes an arrester bracket to a mounting bracket.

It is a still further object of the present invention to provide an insulating cap that protects wildlife from accidental electrocution.

It is a still further object of the present invention to provide an insulating cap that may be used in connection with a wide variety of brands of arrester brackets made by different manufacturers.

It is a still further object of the present invention to provide an insulating cap that serves both as a perch deterrent and an insulating barrier.

It is a still further object of the present invention to provide an insulating cap in which the insulating properties of the material combined with the air space below the cover provide sufficient electrical insulation to prevent electrical arcing.

Toward the fulfillment of these and other objects and advantages, the insulating cap of the present invention has one or more slots sized to accept edges of a rib of an arrester bracket so that the cap may be affixed to the rib by sliding the cap over the rib. Tabs at lower portions of the slotted side portions provide for snap fitting the cap to the rib. A cover portion of the cap extends forward from the slotted portion and is sized to at least partially cover a bolt or fastener that connects the arrester bracket to a mounting bracket that is, in turn, affixed to a transformer tank. The cover portion has curved or rounded upper surfaces to serve as a perch deterrent. The insulating cap is formed from a UV stabilized, polypropylene copolymer.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
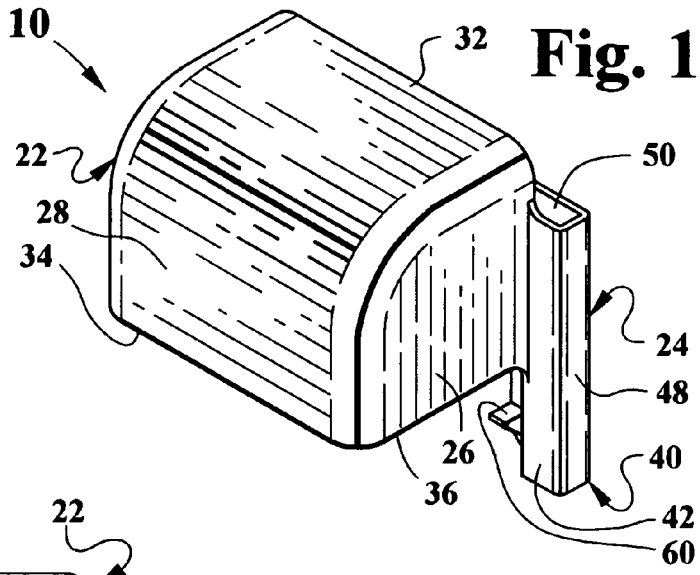
FIG. 1 is a perspective view of an insulating cap of the present invention.
Figure 2:
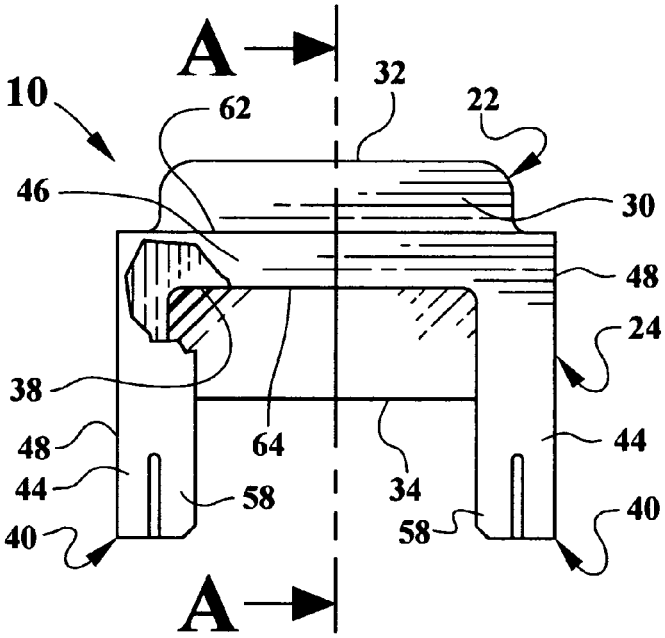
FIG. 2 is a rear elevation view of an insulating cap of the present invention.
Figure 3:
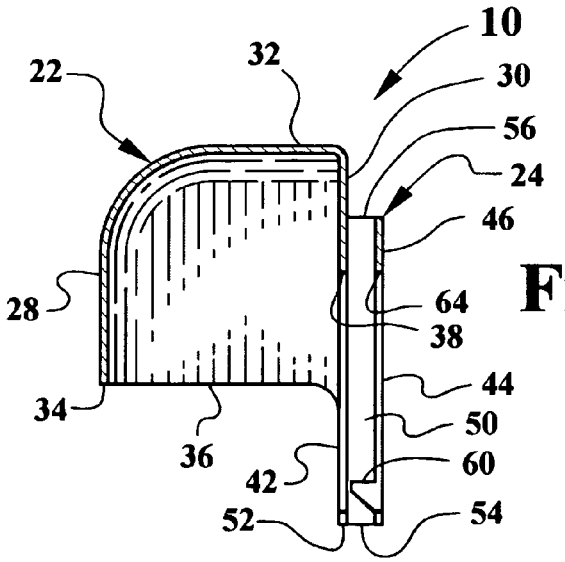
FIG. 3 is sectional view, taken along line A—A, of an insulating cap of the present invention.
Figure 4:
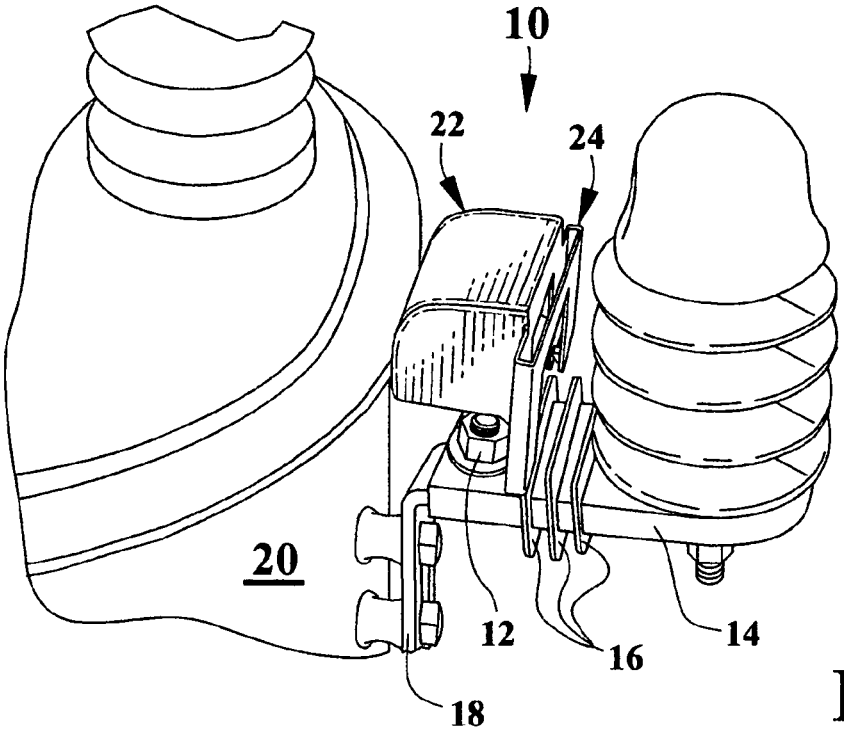
FIG. 4 is a perspective view of a combination of the present invention, showing an insulating cap as it is being slid onto a rib of an arrester bracket.
Figure 5:
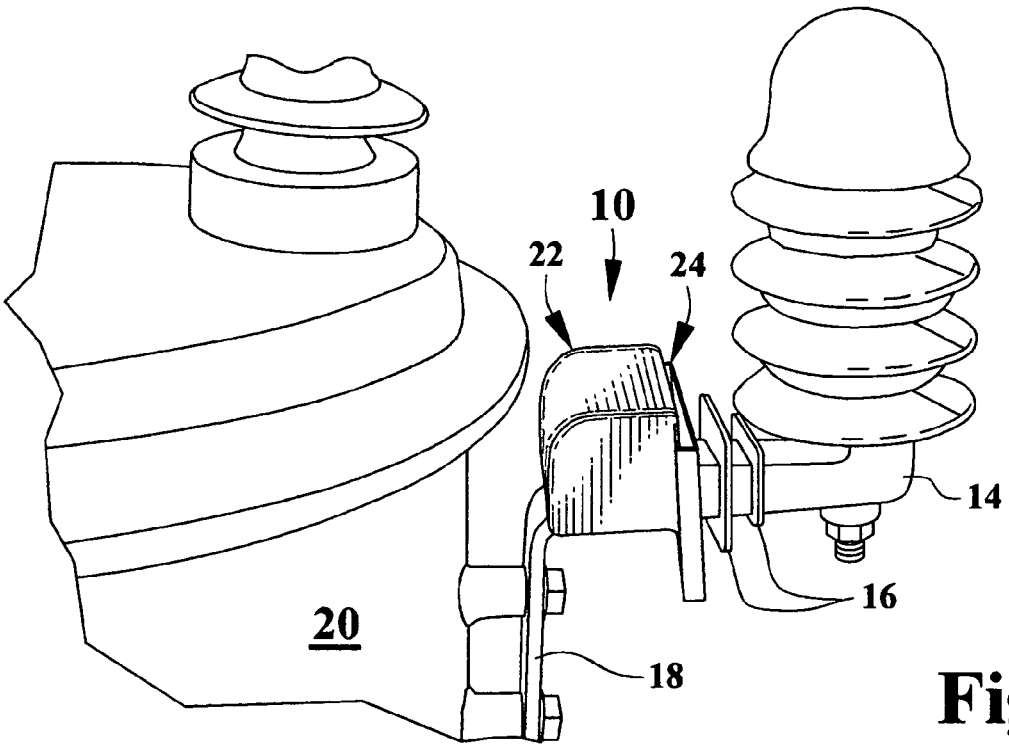
FIG. 5 is a perspective view of a combination of the present invention, showing an insulating cap in place on a rib of an arrester bracket.

Referring to FIG. 1, the reference numeral 10 refers in general to a cap of the present invention. In the preferred combination, the cap 10 is used to cover a fastener 12 that affixes an arrester bracket 14 having ribs 16 to a mounting bracket 18, which is in turn affixed to a transformer tank 20.

The cap 10 has a front, cover portion 22, and a rear, slotted portion 24. The cap 10 may be made from any number of different materials but is preferably made from an insulating material. The material is preferably plastic, is more preferably a polypropylene copolymer, and is most preferably a premium grade, track resistant, UV stabilized polypropylene copolymer. The cover portion 22 has substantially vertical side faces 26 and substantially vertical front 28 and rear faces 30 and a substantially horizontal upper face 32. Portions of the upper surfaces connecting the front face 28 and side faces 26 to the upper face 32 are curved or rounded. Lower edges 34 and 36 of the front face 28 and side faces 26 are disposed lower than a lower edge 38 of the rear 30.

The rear, slotted portion 24 is formed integrally with the front, cover portion 22 and has two substantially identical side portions 40. Front faces 42 of the side portions 40 are connected by the cover portion 22, and rear faces 44 of the side portions 40 are connected by an upper, cross member 46. Because the two side portions 40 are substantially identical, only one side portion 40 will be described in detail. Each side portion 40 has a front face 42, a side face 48, and a rear face 44 that define a slot 50. The slot 50 is sized to accept and slide over and onto a rib 16 of an arrester bracket 14. The front face 42 of the slotted portion 24 is substantially vertical and is aligned with the rear face 30 of the cover portion 22. An upper edge of the front face 42 of the slotted portion 24 is disposed below the upper face 32 of the cover portion 22 and above the lower edge 38 of the rear face 30 of the cover portion 22. A lower edge 52 of the front face 42 of the slotted portion 24 is disposed lower than the lower edges 34 and 36 of the front face 28 and side faces 26 of the cover portion 22. The front face 42 of the slotted portion 24 is narrower than the rear face 44 of the slotted portion 24.

The side face 48 of the slotted portion 24 is substantially vertical and is disposed outward from the side face 26 of the cover portion 22. The width of the side face 48 of the slotted portion 24 is selected so that the slot 50 will accommodate a rib 16 of an arrester bracket 14. Upper and lower edges 56 and 54 of the side face 48 of the slotted portion 24 are disposed at the same level as upper and lower edges of the front and rear faces 42 and 44 of the slotted portion 24.

The rear face 44 of the slotted portion 24 is substantially vertical and is substantially parallel to the front face 42 of the slotted portion 24. A flexible finger 58 is formed in the rear face 44 of the slotted portion 24. A tab 60 is disposed at a lower portion of an inner surface of the flexible finger 58. The tab 60 projects in a forward direction, into the slot 50. The tab 60 has a sloped lower surface and a substantially horizontal upper surface. Cross member 46 connects the rear faces 44 of the side portions 40. An upper edge 62 of the cross member 46 is aligned with the upper edges of the front, side, and rear faces of the side portions 40. A lower edge 64 of the cross member 46 is aligned with the lower edge 38 of the rear face 30 of the cover portion 22.

The cap 10 of the present invention is particularly useful when it is used to cover a fastener 12, such as a bolt, that affixes an arrester bracket 14 having ribs 16 to a mounting bracket 18, which is in turn affixed to a transformer tank 20. In operation, a user positions the cap 10 above an arrester bracket 14 and aligns the slotted portion 24 of the cap 10 with the rib 16 of the arrester bracket 14 that is closest to the connecting bolt 12. The user pushes the cap 10 downward so that the slotted portion 24 engages and slides along side edges of the rib 16. The resilient, flexible fingers 58 facilitate easy rearward movement of the tabs 60 as the tabs 60 contact and are biased against the rib 16. When the tabs 60 move below a lower portion of the rib 16, the resilient, flexible fingers 58 move the tabs 60 into a locking position below a lower portion of the rib 16 to resist removal or upward movement of the cap 10 relative to the rib 16.

Once installed, the lower edge 38 of the rear face 30 of the cover portion 22 rests on the arrester bracket 14 in front of the rib 16, and the lower edge 64 of the cross member 46 rests on the arrester bracket 14 behind the rib 16. The cover portion 22 extends forward from the rib 16 to at least partially cover the connecting bolt 12 and upper portions of the mounting bracket 18. Lower edges 36 and 34 of the side faces 26 and front face 28 of the cover portion 22 are disposed below the connecting bolt 12 and below an upper surface of the arrester bracket 14. The cover portion 22 does not contact the connecting bolt 12 and instead provides air space between the cover portion 22 and the connecting bolt 12. The insulating properties of the cap 10 material, in combination with the air space provided, achieve a high insulating value, such as an insulating value that can reach or exceed 21 KV to ground. Once installed, the curved or rounded, smooth upper surfaces of the cover portion 22 deter wildlife from perching on the cap 10. The cover portion 22 also shields high voltage components from contact by wildlife.

To remove the cap 10, the user simply urges the tabs 60 rearward so that they clear the rib 16 and pushes or pulls the cap 10 off of the rib 16. No cumbersome latches, tie straps, tape, or tools are needed for installation or removal.

Other modifications, changes and substitutions are intended in the foregoing, and in some instances, some features of the invention will be employed without a corresponding use of other features. For example, the cap 10 may take any number of different sizes, shapes, or configurations. Tabs 60 may or may not be used and, if used, may take any number of different sizes, shapes, or configurations. Similarly, the tabs 60 may be disposed in any number of different locations and, for example, may be disposed on the front or side faces 42, 48 of the side portions 40. The cap 10 may be made from any number of different materials or different combinations of materials. Also, the cover portion 22 and slotted portion 24 may be formed or connected in any number of different manners, for example, with upper, lower, and side surfaces disposed at any number of different heights, widths, and orientations. The cover portion 22 may be sized to cover less or more area. The cap 10 may be used in combination with any number of ribbed components and is not limited to use in connection with arrester brackets 14. Of course, quantitative information is included by way of example only and is not intended as a limitation as to the scope of the invention. Accordingly, it is appropriate that the invention be construed broadly and in a manner consistent with the scope of the invention disclosed.

What is claimed is:

1. A combination, comprising:

a transformer tank;

a mounting bracket affixed to said tank;

an arrester bracket, said arrester bracket having at least one rib;

a fastener affixing said arrester bracket to said mounting bracket; and an insulating cap affixed to said at least one rib, said insulating cap at least partially covering said fastener.

2. The combination of claim 1, wherein said fastener comprises a bolt.

3. The combination of claim of claim 1, wherein said at least one rib comprises a plurality of insulating ribs.

4. The combination of claim 1, wherein said insulating cap is comprised of a polypropylene copolymer.

5. The combination of claim 1, wherein said insulating cap is affixed to said at least one rib by snap fitting said insulating cap to said at least one rib.

6. The combination of claim 1, wherein said insulating cap comprises:

a front, cover portion and a rear, slotted portion, said rear slotted portion of said insulating cap being slidable over said at least one rib.

7. The combination of claim 1, wherein said insulating cap comprises:

a front, cover portion and a rear, slotted portion, said rear, slotted portion having at least one tab disposed at a lower portion thereof; said rear slotted portion of said insulating cap being slidable over said at least one rib until said at least one tab is disposed below a lower surface of said at least one rib.

8. A method, comprising:

(1) affixing a mounting bracket to a transformer tank;

(2) affixing an arrester bracket to said mounting bracket using a fastener, said arrester bracket having at least one rib; and (3) affixing an insulating cap to said at least one rib so that said insulating cap at least partially covers said fastener.

9. The method of claim 8, wherein step (3) comprises snap fitting said insulating cap to said at least one rib so that said insulating cap at least partially covers said fastener.

10. The method of claim 8, wherein:

said insulating cap comprises a front, cover portion and a rear, slotted portion; and step (3) comprises sliding said rear, slotted portion of said insulating cap over said at least one rib so that said front, cover portion of said insulating cap at least partially covers said fastener.

11. The method of claim 8, wherein:

said insulating cap comprises a front, cover portion and a rear, slotted portion, said rear, slotted portion having at least one tab disposed at a lower portion thereof; and step (3) comprises sliding said rear, slotted portion of said insulating cap over said at least one rib until said at least one tab is disposed below a lower surface of said at least one rib and so that said insulating cap at least partially covers said fastener.

12. A combination, comprising:

a cap, said cap comprising:

a first side portion defining a first slot, said first slot being sized to accept a first edge portion of a rib on a bracket;

a first tab extending from a lower portion of said first side portion, said first tab being disposed so that it may move into a locking position below a lower portion of said rib to resist upward movement of said first side portion relative to said rib;

a second side portion defining a second slot, said second slot being sized to accept a second edge portion of said rib; and a cover portion affixed to or formed integrally with said first and second side portions, said cover portion extending forward from said first and second side portions.

13. The combination of claim 12, further comprising:

a second tab extending from a lower portion of said second side portion, said second tab being disposed so that it may move into a locking position below a lower portion of said rib to resist upward movement of said second side portion relative to said rib.

14. The combination of claim 12, further comprising said bracket having said rib.

15. The combination of claim 14, wherein said bracket comprises an arrester bracket.

16. The combination of claim 15, further comprising a mounting bracket, said mounting bracket being affixed to said arrester bracket.

17. The combination of claim 16, further comprising a transformer tank, said mounting bracket being affixed to said transformer tank.

18. The combination of claim 12, wherein said cover portion comprises a curved upper surface.

19. The combination of claim 12, wherein said cap is comprised of a UV stabilized copolymer.

20. The combination of claim 12, wherein said cap is comprised of a polypropylene copolymer.

* * * * *